United States Patent [19]

Walker et al.

[11] Patent Number: 4,817,531

[45] Date of Patent: Apr. 4, 1989

[54] CAPSULE CHARGE RETAINING DEVICE

[75] Inventors: Jerry L. Walker, Fort Worth; Jerry Motley, Arlington; Glenn Christopher, Fort Worth, all of Tex.

[73] Assignee: Jet Research Center, Inc., Arlington, Tex.

[21] Appl. No.: 145,077

[22] Filed: Jan. 19, 1988

Related U.S. Application Data

[63] Continuation-in-part of Ser. No. 106,472, Oct. 5, 1987, Pat. No. 4,784,061.

[51] Int. Cl.[4] ..... E21B 7/00

[52] U.S. Cl. ..... 102/306; 89/115; 102/476; 102/481

[58] Field of Search ..... 102/306, 308, 309, 307, 102/310, 475, 476; 175/4.6

[56] References Cited

U.S. PATENT DOCUMENTS

| | | | |
|---|---|---|---|
| 2,494,256 | 1/1950 | Muskat et al. | 175/4.6 |
| 2,707,917 | 5/1955 | Lindsay, Jr. et al. | 102/306 |
| 2,708,408 | 5/1955 | Sweetman | 89/1.15 |
| 2,742,857 | 4/1956 | Turechek | 89/1.15 |
| 2,750,884 | 6/1956 | Gaines | 175/4.6 |
| 2,764,938 | 10/1956 | Harcus | 175/4.6 |
| 2,799,224 | 7/1957 | Long | 175/4.6 |
| 2,960,930 | 11/1960 | Bell | 89/1.15 |
| 2,981,185 | 4/1961 | Caldwell | 175/4.53 |
| 3,016,014 | 1/1962 | Lebourg | 102/306 |
| 3,048,101 | 8/1962 | Lebourg | 175/4.6 |
| 3,327,630 | 6/1967 | Bell | 102/476 |
| 3,670,828 | 6/1972 | Bennett | 175/4.6 |
| 3,739,723 | 6/1973 | Hakala | 175/4.6 |
| 3,955,504 | 5/1976 | Romney | 102/476 |
| 3,991,836 | 11/1976 | Bouguyon et al. | 175/4.6 |
| 4,179,003 | 12/1979 | Cooper et al. | 102/310 |
| 4,273,047 | 6/1981 | Rommer et al. | 102/310 |

FOREIGN PATENT DOCUMENTS

| | | | |
|---|---|---|---|
| 1070536 | 12/1959 | Fed. Rep. of Germany | 102/306 |
| 837900 | 6/1960 | United Kingdom | 102/306 |

*Primary Examiner*—Deborah L. Kyle
*Assistant Examiner*—Michael J. Carone
*Attorney, Agent, or Firm*—Robert A. Kent

[57] ABSTRACT

A method and means for sealed joinder of case and cap members of a capsular shaped charge wherein opposing frustoconical shoulders are formed in adjacent walls of a case and cap and a resilient ring is retained therein to hold the case and cap in operative assembly and an elastomeric ring is positioned in a groove in the case member whereby it is under compressive deformation between the case and cap members when joined to seal the shaped charge from external pressures and fluids while allowing relative rotation of case and cap; wherein increasing external pressures, as in the well bore, will increase the sealing effect and strength of joinder of the assembly.

16 Claims, 5 Drawing Sheets

CAPSULE CHARGE RETAINING DEVICE

CROSS-REFERENCE TO RELATED APPLICATION

The present application is a continuation-in-part of U.S. application Ser. No. 106,472 filed Oct. 5, 1987, now U.S. Pat. No. 4,784,061.

BACKGROUND OF THE INVENTION

1. Field of the Invention

The present invention relates to capsular bodies for housing shaped charges and, more particularly, but not by way of limitation, it relates to an improved method and apparatus for sealing capsule members into an operative assembly.

2. Description of the Prior Art

Prior art forms of shaped charge as used for perforation of oil well casing and the like has taken a great many forms in the past. More recent developments have lead to the smaller, capsule-type shaped charges which can be utilized in suitable suspended arrays for downward insertion through well tubing or other narrow confines. One type of capsule shaped charge housing has consisted of a case for containing the shaped charge and a cap for secure positioning to enclose thereover, and the charge housing assembly is then held in tight closure by means of an adhesive. Still other types of capsule housing may include sealing O-rings, and the cap is then secured to the case by means of press-fit, threads, set screws or bonding agents, but in any event a rigid, secure, fluid-tight connection is made.

SUMMARY OF THE INVENTION

The present invention relates to an improvement in shaped charge capsule housings wherein the housing cap is maintained securely on the housing case by means of a resilient ring positioned between opposing shoulders formed in adjacent walls of the case and cap members and a compressed, elastomeric O-ring is disposed in a grooved recess between the cap and case side walls to seal the shaped charge from external pressures and fluids. Thus, the cap is reliably retained in position on the case to maintain the shaped charge in complete assembly while the case portion may be freely rotated relative to the cap member in order to accomodate threading of the detonator cord and facilitate the alignment of a plurality of such charges in a holder strip. In addition, the O-ring tends to extrude under increased external pressure as encountered down-hole to provide an increasingly tight seal.

Therefore, it is an object of the present invention to provide a capsule charge that is easy to assemble and relatively safer for transport and storage.

It is also an object of the present invention to provide a capsule charge that is more easily manipulated during alignment and arming of a series of charges on a holder strip.

It is yet another object of the invention to provide a charge capsule assembly that exhibits a proportionately greater sealing capability with increase of external pressure.

Finally, it is an object of the present invention to provide a capsule-type shaped charge that is easy to handle in use and with less likelihood of violent explosion during storage and transportation.

Other objects and advantages of the invention will be evident from the following detailed description when read in conjunction with the accompanying drawings which illustrate the invention.

BRIEF DESCRIPTION OF THE DRAWINGS

FIG. 8 is an end view of a metal ring for use in joining the case and cap members.

DETAILED DESCRIPTION OF THE INVENTION

Figure 1:
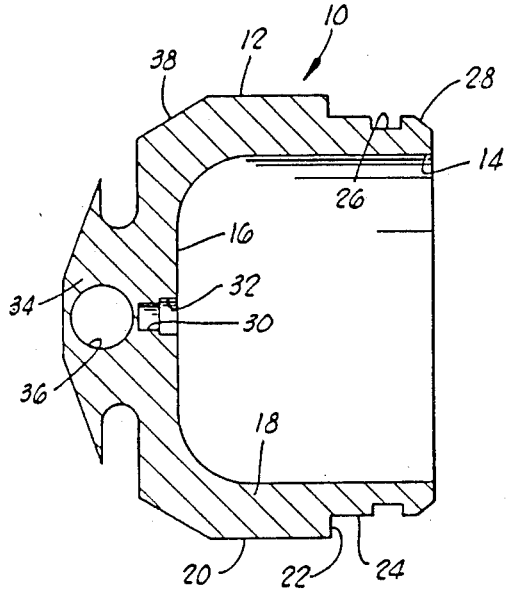
FIG. 1 is a vertical section of a capsule charge case member.

Referring to FIG. 1, a capsule charge case member 10 is formed generally as a cylinder 12 having an open end 14 and a closed end 16 the cylinder wall portion 12 is formed to have an inside wall 18 and an outside wall 20 which is formed through an annular shoulder 22 to provide a lesser diameter outer wall 24 adjacent open end 14. A rectangular groove 26 is formed circumferentially around cylinder wall 24 spaced from the open end 14 and a bevel edge 28 is formed circumferentially around end wall 29 at the terminus of cylinder wall 24.

A relatively small diameter bore 30 with a counter bore 32 is formed axially in closed end 16 to provide a small volume for holding booster charge. A vane formation 34 is formed to bisect the closed end 16 on the outer surface, and this vane includes an aperture 36 for receiving detonator cord therethrough. This type of capsule charge case member is generally known in the art, the departure being the formation of circumferential groove 26 proximate open end 14. The case member 10 may be formed from selected steel and finished with a flash zinc plate under clear chromate. Cylinder corners such as 38 are formed at an angle to enable the assembled capsule charge to be disposed within a minimum diameter measure, as will be further described below.

Figure 2:
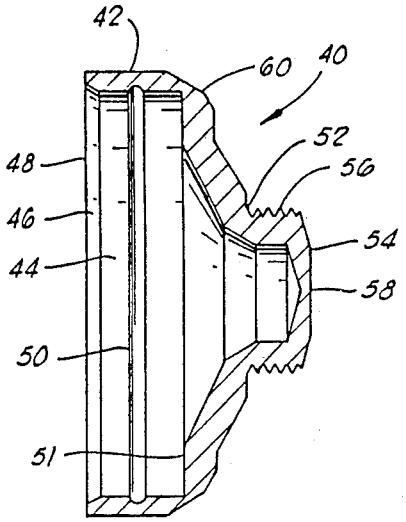
FIG. 2 is a vertical section of a capsule charge cap member.

FIG. 2 illustrates a cap member 40 which is formed as a body of revolution with a cylindrical side wall 42 having an inner wall 44 that terminates through a bevel 46 at open end wall 48. An arcuate groove 50, an arc slightly less than a semi-circle, is formed circumferentially around the inner wall 44 at selected spacing from end wall 48. An annular end wall 51 is formed around the inner surface of closed end 52 of case 40. The closed end 52 is formed generally as a conical member 54 merging into side wall 42 and being unitarily formed into a threaded boss portion 54. The boss portion 54 is round and includes threads 56, and a center portion 58 is formed as a thinnest point to receive explosive force puncture therethrough. Threads 56 are formed to allow threaded insertion of the capsule charge into a suitable holder strip. Here again, corners are rounded off to present such as shoulders 60 for the purpose of allowing clearance through a minimal diameter space.

Figure 3:
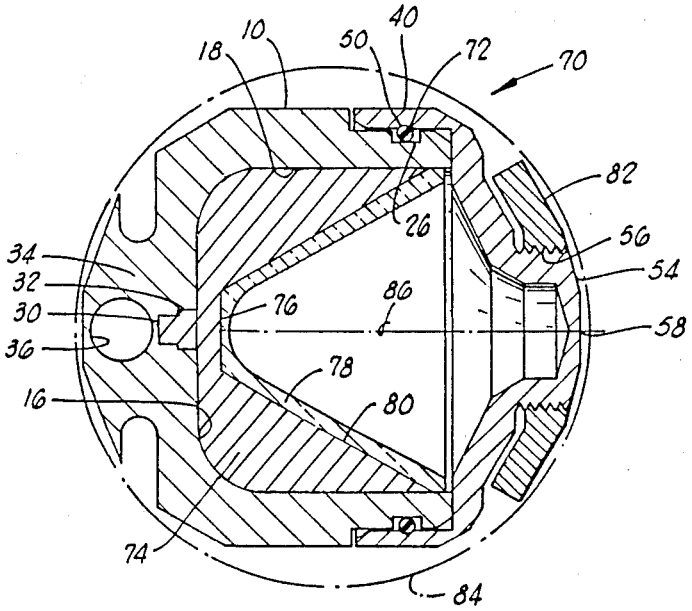
FIG. 3 is a vertical cross-section of an assembled capsule charge including the shaped charge material.

FIG. 3 illustrates a full capsule charge assembly 70 including the case 10 and cap 40 as assembled and secured by means of an O-ring 72 compressively seated within groove 26 and mating arcuate groove 50. A selected explosive charge 74, e.g. RDX Explosive, or other compressible high explosive material, is formed and inserted within inner side walls 18 adjacent rear wall 16. A selected booster explosive is placed in the counter bores 30, 32 which terminates adjacent aperture 36 and the detonator cord placed therein, e.g. PRIMACORD. Finally, a liner cone 78 is seated by means of a suitable bonding agent down within the conical surface 80 of the compressed explosive 74 thereby to complete the shaped charge.

The boss end 54 of cap 70 is then engaged by means of thread 56 within a suitable holder strip 82. The holder strip 82 may be of any selected length having a plurality of spaced holes for receiving charge insertion, the size and spacing depending on the exigencies of the particular shooting operation. It may be noted too that the holder strip 82 is arcuately shaped to maintain the circular outline so that the holder strip 82 plus shaped charge 70 may be clearly drawn through a selected size of tubing. The dash line 84 outlines a minimum diameter clearance relative to the capsule charge assembly and holder strip. Detonation of the charge tends to direct the explosive force jet along cylindrical axis 86 and through boss wall point 58 into whatever the adjacent structure or material.

In operation, no adhesive, threads or other bonding agent is required to secure the cap 40 over the open end of case 10. The O-ring 72 is compressively retained between mating grooves 26 and 50 to provide sufficient retentive grip to maintain the assembly in firm, fluid-tight affixure while also enabling some additional operational advantages, as will be further described.

One type of O-ring 72 that is suitable for use as a retention and sealing member is a compound C67 type consisting of peroxide cured nitrile as available from National 0-Rings Division of Federal Mogul Corporation, Downey, Calif. This type of O-ring has a hardness of 88 durometer, tensile strength of 2825 psi, an elongation of about 90% and specific gravity of 1.29. Other similar O-rings constructed of lighter or heavier materials e.g. ethylenepropylene, or various VITON Types, may be used, depending upon the exigencies of the particular application. All such O-ring compound selections are available from National 0-Rings, as identified above.

Figure 4A:
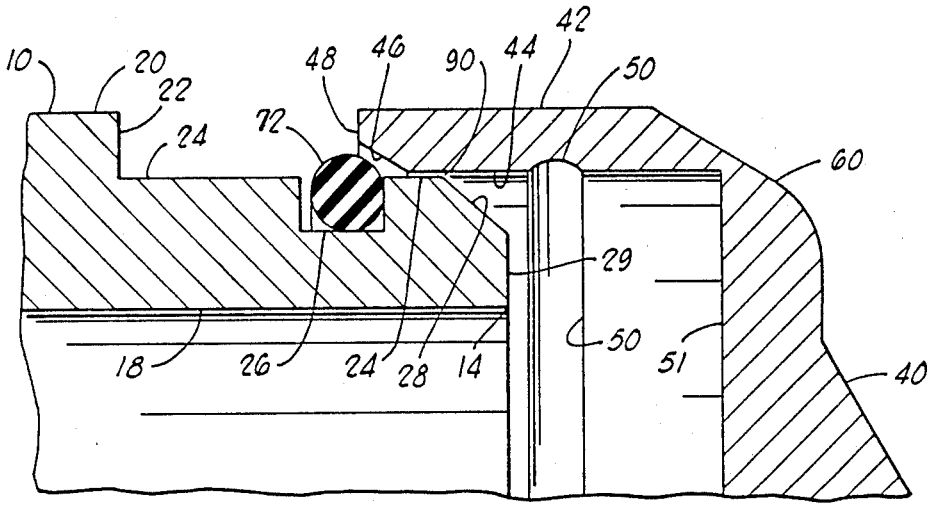
FIGS. 4A, 4B, 4C, and 4D are a vertical section of a portion of a capsule charge illustrating three different stages of assembly and the effects of high pressure on the O-ring of an assembled capsule charge.

Referring to FIG. 4A, the beginning of assembly of a case 10 and cap 40 shows positioning of the O-ring 72 in the rectangular groove 26 formed in the outer cylinder wall 24 of case 10. The cap 40 is then pushed over open end 14 with bevel edge 46 meeting and compressing O-ring 72 as the cap 40 is moved thereover into operative position. A small clearance 90 may be noted between cap inner wall 44 and the case outer cylindrical wall 24. This is a totally free, unbinding clearance of minimal dimension, i.e. easily slidable.

Figure 4B:
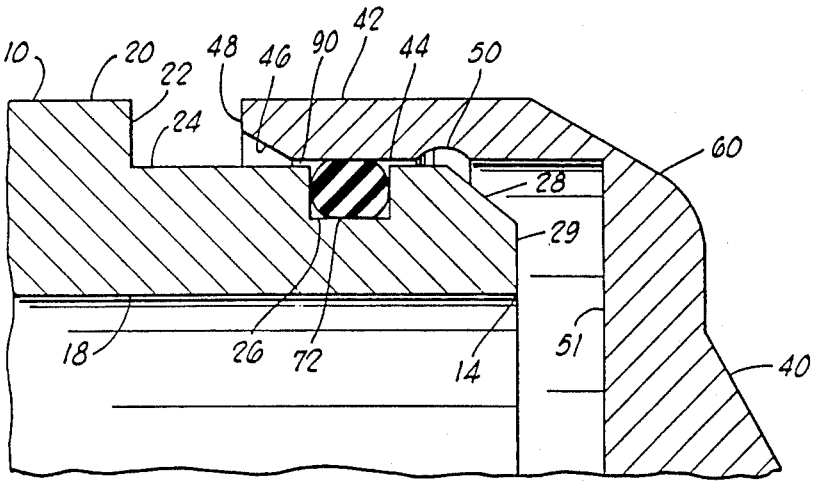
Figure 4C:
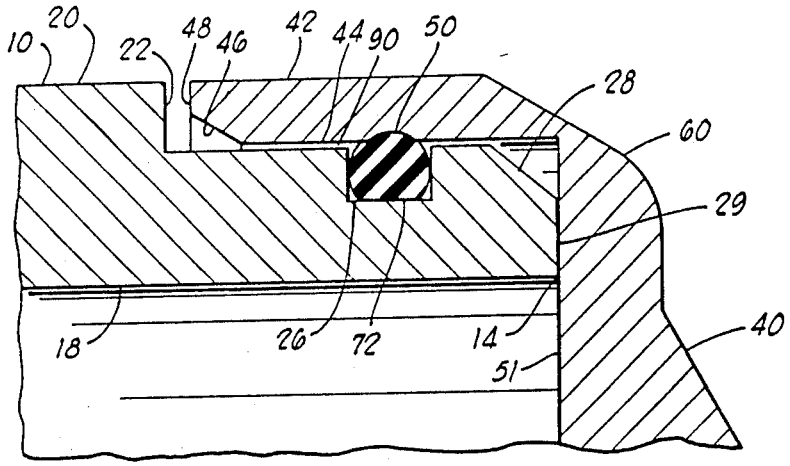

FIG. 4B then shows an intermediate assembly position wherein the bevel edge 46 of cap member 40 has been pressed entirely over O-ring 72 to hold it in a compressed state, and the minimal clearance 90 is maintained between the mating cylinder walls so that an easily sliding but non-constricting or binding fit is achieved. FIG. 4C then proceeds to the full snap-fit engagement position wherein groove 50 is moved to super position over O-ring 72 which exerts an expansive force therein to provide sealing retention of the cap member 40 over open end 14 of case 10. In this operationally engaged attitude, the annular end wall 29 of case 10 is brought into abutment with rear annular wall 51 of cap 40.

The operational attitude of FIG. 4C has been found suitable for initial assembly and transportation of capsule charge units while also enabling easier handling and set-up in the field. That is, the O-ring seal snap-fit retention of case and cap is sufficiently strong for storage and transportation and actually provides a benefit as regards a degree of fire hazard. Due to the relatively loose coupling the charges may be transportable as a Class C explosive so that, in case of fire, the case and cap are easily separated so that the explosives contained therein will burn instead of exploding. Further, when setting up shots in the field, the threaded boss 54 is inserted in a holder strip 82 and then the case member 10 can be easily rotated while in sealing engagement to align the fuse aperture 36 in whatever orientation to easily receive a detonator cord.

Figure 4D:
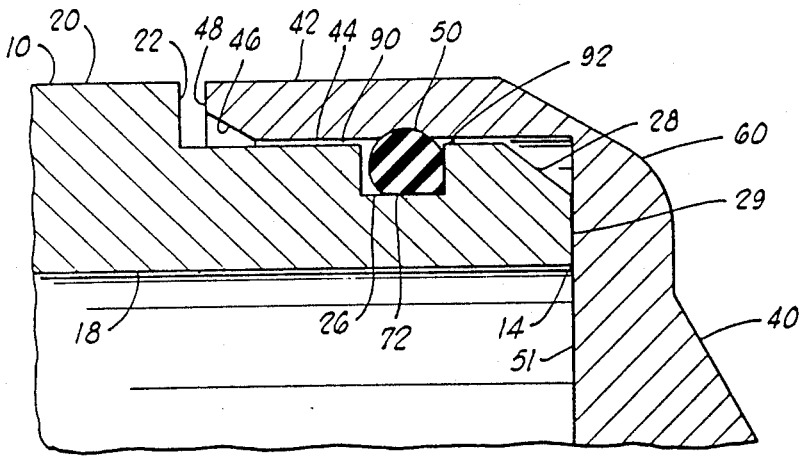

Yet another and a very important operational advantage is achieved during usage of the capsule charges in high pressure environments. Refer to FIG. 4D. As the capsule charges are lowered down into the high pressure depths of a well bore, the O-ring 72 tends to extrude under force of external pressure present via clearance 90 such that O-ring 72 extrudes and tightly seals as shown at flow point 92.

This extruded condition was borne out by means of a static pressure test as performed on a 2⅛ inch diameter capsule charge. Before subjection to pressure, it was found that seventy pounds force was required to pull the cap 40 from case 10 as retentively assembled with an O-ring 72. An identical type of capsule charge was then subjected to an external pressure of 15,000 PSI at 325° F. for a period of one hour. After the pressure test, the cap and case were still in uniform assembly and the case did not leak in any way; however, it required a force of 250 pounds to pull the cap 40 from the case 10 and the O-ring 72 was still in good condition albeit that it had been subjected to some extrusion.

Further safety testing in the nature of fire test was carried out on both 1 11/16 inch and 2⅛ inch capsule charges. Three 1 11/16 inch capsule charges were placed in a flaming fire environment for observance of behavior. In each case, the caps merely popped off from the cases and the enclosed explosive charge gassed off after elapsed times of approximately one minute and forty-five seconds. The caps were each found intact close by the test area.

Three additional larger charges of 2⅛ inch capsule charge were tested in like manner and observed from a safe vantage point. Here again, all three of the explosive charges had gassed off and all three caps were found intact i.e., non-destructed or exploded, and within a few feet of the original capsule charge placement. In addition, each of the cases still retained the liner cone as the explosive charge apparently gassed off with minimal disturbance of the cone members.

The foregoing discloses a novel means for retentively assembly case and cap of a capsule type shaped charge. Case and cap are maintained in operative, sealed assembly by the compressed O-ring, yet the capsule charge has enhanced operational features as well as increased safety in handling and transportation. While the invention has been described in relation to a capsule shaped charge of the perforator type, it should be understood that it may be utilized with tubing cutter charges and other types of explosive containers. It is a distinct advantage in any of many applications where an O-ring can provide sufficient grip to maintain assembly of an explosive container but will still allow gassing off of the explosive in the event of accidental ignition. It should be understood too that male/female joinder of case and cap open ends is a matter of design choice.

Figure 5:
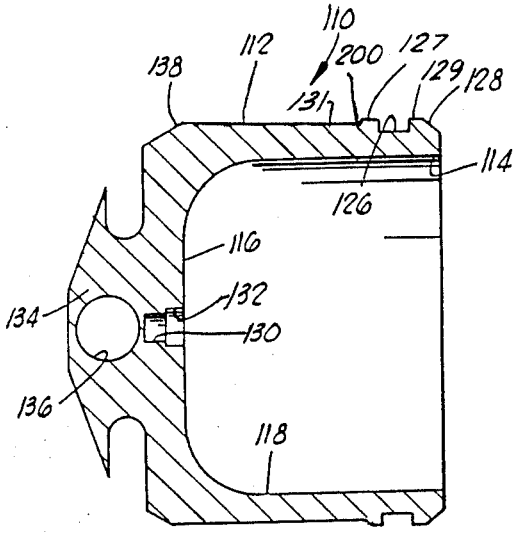
FIG. 5 is a vertical section of a capsule charge case member.
Figure 6:
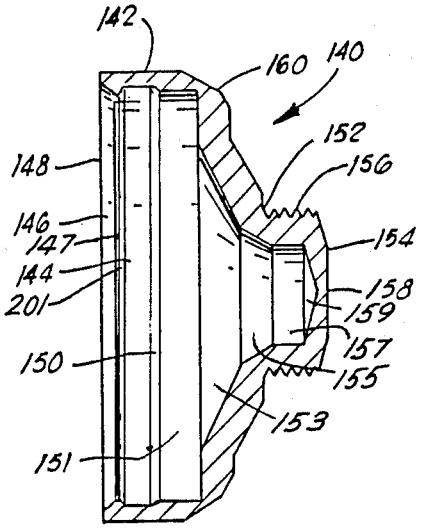
FIG. 6 is a vertical section of a capsule charge cap member.
Figure 7:
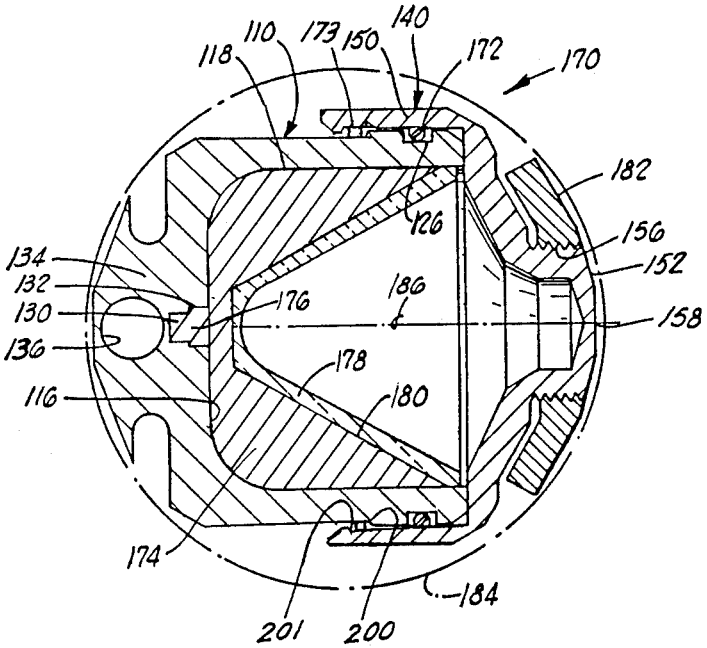
FIG. 7 is a vertical cross-section of an assembled capsule charge including the shaped charge material.
Figure 5:
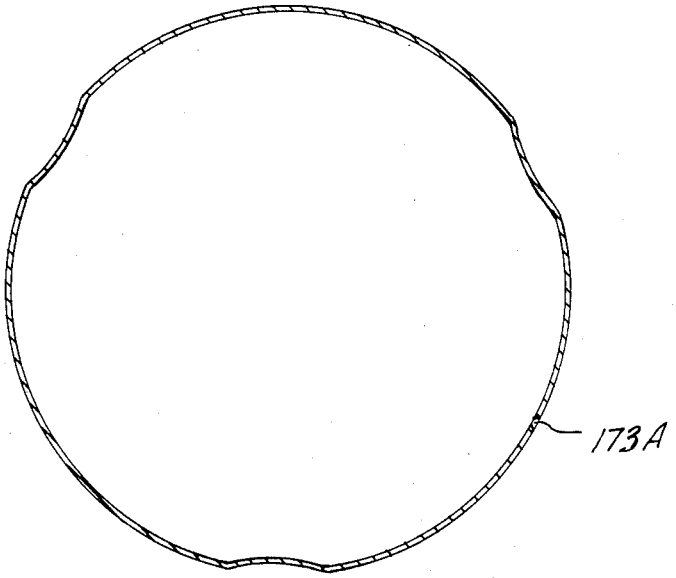

Referring to FIGS. 5, 6 and 7 an alternate and preferred embodiment of the invention is illustrated. In FIG. 5, a capsule charge case 110 is formed generally as a cylindrical body 112 having an open end 114 and a closed end 116. The inside of case 110 comprises a generally cylindrical bore having a wall 118 with a first bore 130 having a relatively small diameter in relation to the diameter of the cylinder formed by wall 118 centered within the closed end 116 of case 110. Bore 130 is provided with a counter bore 132 to provide a small volume for holding a booster charge. A vane formation 134 is formed to bisect the closed end 116 on the outer surface and this vane includes an aperture 136 for receiving a detonator cord therethrough.

The annular surface of body 112 has a first frustoconical surface 128 extending from the periphery of open end 114 which adjoins a first cylindrical surface 129. A first annular recess 126 is positioned adjacent to surface 129 on body 112 to receive and hold an elastomeric seal or O-ring. A second cylindrical surface 127 having substantially the same diameter as surface 129 is positioned adjacent to recess 126. A third cylindrical surface 131 having a smaller diameter than surface 127 is positioned adjacent to surface 127 whereby surface 127 and surface 131 are connected by a frustoconical surface 200 which functions as an annular shoulder against which a retaining ring can bear. A third frustoconical surface 138 extends from the edge of surface 131 to the end of cylindrical body 112. This type of capsule charge case member is generally known in the art, the departure being the formation of the recess 126 and the annular frustoconical shoulder 200 created between surfaces 127 and 131. The case 110 may be formed from various types of steel or other metals and may be finished, for example with a flash zinc plate under clear chromate.

FIG. 6 illustrates a cap member 140 which is formed as a body of revolution with a cylindrical annular surface 142 having an inner opening 148. Opening 148 comprises a first generally frustoconical surface 146 which is adjacent a first cylindrical surface 147. An annular recess 144 adjoins surface 147 and is connected thereto by a second frustoconical surface 201 The intersection of surface 147 and recess 144 creates a frustoconical shoulder against which a retaining ring can bear. A third frustoconical surface 150 extends from recess 144 to a second cylindrical surface 151 which may have a diameter substantially the same as that of surface 147. The diameter of surfaces 147 and 151 is such that cap member 40 can be positioned over the open end portion of body 112 and slidably moved over to surround surfaces 127 and 129 of body 112. Adjoining surface 151 are a fourth frustoconical surface 153 and fifth frustoconical surface 155 having progressively smaller diameters whereby a bore 157 can be axially positioned in the end opposite opening 148 adjoining surface 155 and terminating in a sixth frustoconical surface 159. The design and specific configuration of surfaces 153, 155 and 157 may vary. For example they may comprise a single surface forming a uniform curve extending to the bottom inner portion of the cap member or be only two surfaces instead of three.

The opposite end of cap member 140 from opening 148 comprises a closed end 152. The exterior surface of closed end 152 is formed generally as a conical member 154 merging into annular surface 142 by means of a frustoconical surface 160 and in this embodiment being unitarily formed into a threaded boss portion including threads 156 on a generally cylindrical portion of conical member 154.

The conical member 154 terminates at an end portion 158 which is formed as the thinnest point between frustoconical surface 159 and the exterior of closed end portion 152 of cap member 140 to receive or permit explosive force puncture therethrough. Threads 156 are formed to allow threaded insertion of the assembled capsule charge into a suitable holder strip. Alternatively, any other suitable attachment method known to individuals in the art could be employed in place of threads 156.

FIG. 7 illustrates a full capsule charge assembly 170 including the case 110 and cap 140 as assembled and secured by means of an elastomeric member 172 in recess 126 and a member 173 which may be press fit about case 110 which comprises a resilient ring or band of a material such as, for example, nylon which is capable of insertion into the cavity created between surfaces 144 and 131 and bounded by the shoulders created by frustoconical surfaces 200 and 201 whereby case 110 and cap 140 are retainably joined. A selected explosive charge 174 such as RDX explosive, or other compressible high explosive material is formed and inserted within inner side wall 118 and adjacent closed end wall 116. A selected booster explosive 176 is placed in bore 130 and counterbore 132 which terminates adjacent aperture 136 into which a detonator cord such as PRIMACORD is positioned. A liner cone 178 is seated by means of a suitable bonding agent down within the formed surface 180 of the high explosive material charge 174 whereby a complete shaped charge is formed. Various types of high explosives, booster explosives, detonator cords and bonding agents are well known in the art and the selection of particular materials is merely a matter of choice by the artisan.

The end 152 of cap 170 then is engaged by means of threads 156 within a suitable holder strip 182. The holder strip 182 may be of any selected length having a plurality of spaced holes for receiving charge insertion, the size and spacing depending on the exigencies of the particular perforating operation. The holder is generally arcuately shaped to maintain a generally circular outline so that the holder strip 182 and charges 170 may be inserted through a selected size of well bore tubing. The dash line 184 outlines a minimum diameter clearance relative to the capsule charge assembly and holder strip. Detonation of the charge 174 tends to direct the explosive force jet along cylindrical axis 186 and through end portion 158 into whatever the adjacent structure or material.

In operation, no adhesive, threads or other bonding agent is required to secure cap 140 over the open end of case 110. The elastomeric member 172 is compressed between mating surface 151 and recess 126 and member 173 retainably engages the shoulders on cap 140 and case 110 as previously described. Members 172 and 173 provide sufficient retentive grip to maintain the assembly in firm, fluid-tight affixure while also enabling the additional operating advantages previously described for charge assembly 70. While not required, surface 151, of cap 140 may have a recess similar to that of cap 40 whereby mating recesses would compressively contact member 172.

The member 172 may be comprised of the same materials previously described regarding sealing member 72. Member 173 may be comprised of a general purpose nylon such as Zytel 101 which is available from McMaster-Carr Supply Company, Chicago, Ill. or any other polymeric material which has sufficient resilience to undergo deformation during the installation process and then resume its form to retainably join the cap and case members of the charge assembly in the manner described. The polymeric material preferably has a reduction in shear strength upon heating to temperatures above about 400° F. whereby the case and cap members can separate without detonation of the charge such as in a fire whereby the assembly may be transported as a Class C explosive.

The charge assembly 170 is assembled in the same manner as charge assembly 70 comprising cap 40 and case 10 as illustrated in FIGS. 4A–D with the additional step of installation of member 173 to retainably engage cap 140 and case 110. The member 173 is installed by any of the various well known methods. In one method, member 173 is positioned about case 110 and pressed into position by placing the case member about which member 173 is positioned in a die positioned in an air or hydraulic operated press. The die has a shoulder which retains the member 173 in a fixed position near the open end portion of case 110 while permitting the cap member to be pressed down over the case into a retainably engaged position. This form of assembly offers the same benefits as the previous embodiment as regards transportation, installation and fire hazards.

To test the effectiveness of the case and cap retention, a 1 11/16 inch diameter capsule charge was subjected to an external pressure of 15,000 PSI at 325° F. for a period of one hour. After the pressure test, the cap and case were still in uniform assembly and the case did not leak in any way. Upon cooling to ambient temperature, it required a force of 800 PSI to pull the cap 140 from the case 110 and the O-ring was still in good condition although it had been subjected to some extrusion.

A fire test was carried out on a box of 1 11/16 inch capsule charges. The charges were placed in a flaming environment for observance of behavior. The caps popped off from the cases and the enclosed explosive charge gassed off after elapsed times of approximately two minutes. The caps were found intact and the explosive charge apparently gassed off with minimal disturbance of the cone liners.

In yet another embodiment of the present invention, member 173 may be comprised of metal. When member 173 is comprised of metal it may have a configuration as set forth in FIG. 8. Member 173A as illustrated in FIG. 8 is a wavy edge ring whereby the various waves provide contact points between the surfaces of the case and cap members. The precise number of waves may vary. The member 173 may also be in the shape of a metal strip which is bent about the case or an oval ring whereby the waves, strip edges or oval ring produce at least two points of contact between the case and cap member when positioned about case 110 such that the case and cap are retainably engaged. The metal which is utilized can comprise, for example, spring steel, tempered stainless steel or untempered stainless steel or the like. When member 173 is metal, frustoconical surfaces 200 and 201 may comprise surfaces which are perpendicular to the adjoining surfaces 131 and 127 and surfaces 144 and 147, respectively, whereby a square shoulder is created against which the metal retainer can bear to retainably engage the case and cap members. The metal member 173 may be positioned about case 110 utilizing means whereby it is caused to flatten out to permit cap 140 to be positioned over the end of case 110. The member 173 then is released whereby it resumes its wavy or other shape such that several points of contact are created between the case and cap members by contact with the opposing shoulders on the members.

While that which is considered to be the preferred embodiment has been described herein, changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A shaped charge device, comprising:

a cylindrical case member having a closed end and an open end with a circumferential groove formed adjacent the open end and a frustoconical shoulder formed adjacent the circumferential groove;

a cylindrical cap member having a closed end and an open end that has diameter of a size for mating engagement with the open end of said case member, and having a frustoconical shoulders formed circumferentially about the surface adjacent the open end of the cap member; and an eleastomeric ring is compressively received within the case groove and a resilient ring is positioned between the frustoconical shoulders of the case member and cap member when said cap member is slidably positioned in mating engagement with said case member whereby said case and cap members are retainably engaged.

2. A device as set forth in claim 1 wherein:

said case groove is a rectangular shape.

3. A device as set forth in claim 1 wherein said elastomeric ring is an O-ring.

4. A device as set forth in claim 2 wherein:

said resilient ring is comprised of nylon.

5. A device as set forth in claim 1 wherein said cap member has an angular bevel on the inner surface extending from the open end of said cap member.

6. A device as set forth in claim 1 wherein said case member comprises:

means formed on the closed end of said case member for receiving detonation of the shaped charge.

7. A device as set forth in claim 1 wherein said means for receiving comprises:

an axial hole formed in the closed end of the cylindrical case member immediately adjacent the shaped charge for containing a booster charge; and means for guiding a detonator adjacent said booster charge.

8. A device as set forth in claim 1 wherein said elastomeric ring is formed of a cured nitrile of preselected hardness.

9. A device as set forth in claim 8 wherein said elastomeric ring has a hardness of 88 on the durometer scale.

10. A method of assembling shaped charged of the type having a case member with an open end for containing a shaped charge and which is placed in mating fluid-tight engagement with the open end of a cap member for receiving and directing the force from the shaped charge, comprising:

placing an elastomeric ring under compressive deformation between the case member and the cap member adjacent walls and a resilient ring between opposing frustoconical shoulders on the case member and cap member adjacent walls so that the cap and case members are relatively rotatable in sealed joinder, and wherein increasing external pressure will cause extrusion of the elastromeric ring and proportionately greater seal integrity.

11. A method as set forth in claim 19 wherein said elastromeric ring is snap-fit into a groove in the case member and the resilient ring is press fit between the case and cap member adjacent walls such that a relatively loose but sealed joinder is effected for normal storage and handling but such sealed joinder is greatly strengthened under external pressure.

12. A shaped charge device, comprising:

a cylindrical case member having a closed end and an open end with a circumferential groove formed adjacent the open end and an annular shoulder formed adjacent the circumferential groove;

a cylindrical cap member having a closed end and an open end that has a diameter of a size for mating engagement with the open end of said case member, and having a shoulder formed circumferentially about the surface adjacent the open end of the cap member; and an elastomeric ring which is compressively received within the case groove and a metal retainer which is positioned between the opposing shoulders of the case member and cap member when said cap member is slidably positioned in mating engagement with said case member whereby said case and cap member are retainably engaged.

13. A device as set forth in claim 12 wherein:

said case groove is of rectangular shape.

14. A device as set forth in claim 12 wherein:

said elastomeric ring is an O-ring.

15. A device as set forth in claim 12 wherein:

said metal retainer is comprised of a material selected from the group of spring steel and stainless steel.

16. The device as set forth in claim 12 wherein said metal retainer has a configuration selected from the group of an oval ring, a wavy edge ring or a strip.

* * * * *